US007794241B2

(12) United States Patent
Bright et al.

(10) Patent No.: US 7,794,241 B2
(45) Date of Patent: Sep. 14, 2010

(54) STRADDLE MOUNT CONNECTOR FOR PLUGGABLE TRANSCEIVER MODULE

(75) Inventors: Edward John Bright, Middletown, PA (US); Michael Frank Cina, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/353,485

(22) Filed: Jan. 14, 2009

(65) Prior Publication Data

US 2010/0178783 A1 Jul. 15, 2010

(51) Int. Cl.
*H01R 12/00* (2006.01)

(52) U.S. Cl. ..... 439/79; 439/59

(58) Field of Classification Search ..... 439/79, 439/638, 637, 607.2, 607.21, 660, 59, 76.1
See application file for complete search history.

(56) References Cited

U.S. PATENT DOCUMENTS 4,293,179 A * 10/1981 Vonder ..... 439/637
4,392,705 A 7/1983 Andrews, Jr. et al.
5,230,633 A * 7/1993 Hisatomi et al. ..... 439/79
5,380,225 A 1/1995 Inaoka
5,766,041 A 6/1998 Morin et al.
5,944,536 A * 8/1999 Seong et al. ..... 439/79
5,980,273 A * 11/1999 Yong et al. ..... 439/79
6,004,160 A 12/1999 Korsunsky et al.
6,007,359 A * 12/1999 Kosmala ..... 439/329
6,071,150 A * 6/2000 Tang et al. ..... 439/638
6,077,093 A * 6/2000 Seong et al. ..... 439/79
6,162,091 A * 12/2000 Kurotori et al. ..... 439/567
6,179,627 B1 * 1/2001 Daly et al. ..... 439/76.1
6,231,355 B1 5/2001 Trammel et al.
6,347,954 B1 * 2/2002 Jones et al. ..... 439/358
6,352,435 B1 * 3/2002 Perino et al. ..... 439/73
6,364,713 B1 * 4/2002 Kuo ..... 439/638
6,478,622 B1 * 11/2002 Hwang ..... 439/607.2
6,517,382 B2 2/2003 Flickinger et al.
6,558,202 B1 5/2003 Hahn
6,589,061 B1 * 7/2003 Korsunsky et al. ..... 439/83
6,666,695 B1 * 12/2003 Yeh ..... 439/79
6,685,485 B2 * 2/2004 Korsunsky et al. ..... 439/79
6,692,273 B1 * 2/2004 Korsunsky et al. ..... 439/108
6,743,057 B2 6/2004 Davis et al.
6,749,468 B2 6/2004 Avery
6,752,663 B2 6/2004 Bright et al.
6,816,376 B2 11/2004 Bright et al.

(Continued)

*Primary Examiner*—T C Patel
*Assistant Examiner*—Vladimir Imas

(57) ABSTRACT

A pluggable module for mating with a receptacle connector of a host device. The pluggable module includes a housing having a front and a rear, a circuit board held by the housing that includes a mating edge and a plurality of contact pads arranged at the mating edge, and a straddle mount connector coupled to the mating edge of the circuit board. The straddle mount connector includes a plurality of contacts engaging corresponding contact pads. The contacts extend between a termination end coupled to the contact pads and a mating end configured to engage corresponding contacts of the receptacle connector. The straddle mount connector also includes a dielectric connector body having a platform for supporting the contacts. The platform includes a plurality of dividers between each of the contacts, where the dividers define a plurality of channels that receive the contacts. The dividers extend from the platform beyond the contacts such that the contacts are recessed below an outer surface of the dividers.

20 Claims, 6 Drawing Sheets

U.S. PATENT DOCUMENTS 6,872,094 B1 * 3/2005 Murr et al. ..... 439/607.2
6,887,108 B2 * 5/2005 Wu ..... 439/638
6,893,293 B2 * 5/2005 Ice et al. ..... 439/607.2
6,926,565 B2 8/2005 Fogg
6,980,437 B2 * 12/2005 Bright ..... 361/704
7,007,217 B2 2/2006 Fujii et al.
7,025,617 B2 4/2006 Regnier et al.
7,044,777 B1 * 5/2006 Daly et al. ..... 439/540.1
7,048,567 B2 5/2006 Regnier et al.
7,070,446 B2 7/2006 Henry et al.
7,090,523 B2 8/2006 Shirk et al.
7,198,519 B2 4/2007 Regnier et al.
7,232,345 B2 * 6/2007 Ishizuka et al. ..... 439/660
7,396,237 B2 * 7/2008 Sakiyama et al. ..... 439/79
7,486,524 B2 * 2/2009 Ice et al. ..... 361/752
2001/0034164 A1 * 10/2001 Crane et al. ..... 439/660
2003/0171012 A1 * 9/2003 Korsunsky et al. ..... 439/79
2003/0171033 A1 * 9/2003 Bright et al. ..... 439/607
2004/0023559 A1 * 2/2004 Wu ..... 439/638
2004/0038566 A1 * 2/2004 Shirai ..... 439/79
2004/0097136 A1 * 5/2004 Flickinger et al. ..... 439/607
2006/0234530 A1 * 10/2006 Chung ..... 439/79
2007/0232091 A1 * 10/2007 Hong ..... 439/66
2008/0218799 A1 * 9/2008 Hiew et al. ..... 358/1.16

* cited by examiner

STRADDLE MOUNT CONNECTOR FOR PLUGGABLE TRANSCEIVER MODULE

BACKGROUND OF THE INVENTION

The subject matter herein relates generally to a transceiver assembly, and more particularly, to an enhanced mating interface for a pluggable module of a transceiver assembly.

Various types of fiber optic and copper based transceiver assemblies that permit communication between electronic host equipment and external devices are known. These transceiver assemblies typically include a module assembly that can be pluggably connected to a receptacle in the host equipment to provide flexibility in system configuration. The module assemblies are constructed according to various standards for size and compatibility, one standard being the Small Form-factor Pluggable (SFP) module standard.

The SFP module is plugged into a receptacle assembly that is mounted on a circuit board within the host equipment. The receptacle assembly includes an elongated guide frame, or cage, having a front that is open to an interior space, and an electrical connector disposed at a rear of the cage within the interior space. Both the connector and the guide frame are electrically and mechanically connected to the circuit board, and when an SFP module is plugged into the receptacle assembly, the SFP module is electrically and mechanically connected to the circuit board as well. Conventional SFP modules and receptacle assemblies perform satisfactorily carrying data signals at rates up to 2.5 gigabits per second (Gbps).

Another pluggable module standard, the XFP standard, calls for the transceiver module to carry data signals at rates up to 10 Gbps. Transmission of data signals at such a high rate compared to SFP modules raises problems not experienced previously in SFP modules. For example, conventional contact configurations at the mating interface of the pluggable transceiver module are inadequate for transmitting data signals at the desired transmission rates. Electrical parameters such as impedance are negatively impacted by the conventional interface of the transceiver module and the receptacle connector. While steps have been taken to solve the signal integrity issues caused by 10 Gbps signals, particularly where there is only one transmit and one receive signal, problems still remain with maintaining signal integrity. For example, there is presently in development by an Industry Group, IEEE P802.3ba "10 Gbps and 100 Gbps Ethernet Task Force", that transmits and receives multiple 10 Gbps signals in a parallel configuration. Systems utilizing the parallel configuration have problems maintaining signal integrity.

It would be desirable to provide an interface for mating with the receptacle assembly that exhibits good electrical characteristics at high data transmission rates. It would be desirable to provide an interface that exhibits good electrical characteristics in systems that transmit and receive multiple 10 Gbps signals in a parallel configuration.

BRIEF DESCRIPTION OF THE INVENTION

In one embodiment, a pluggable module is provided for mating with a receptacle connector of a host device. The pluggable module includes a housing having a front and a rear, a circuit board held by the housing that includes a mating edge and a plurality of contact pads arranged at the mating edge, and a straddle mount connector coupled to the mating edge of the circuit board. The straddle mount connector includes a plurality of contacts engaging corresponding contact pads. The contacts extend between a termination end coupled to the contact pads and a mating end configured to engage corresponding contacts of the receptacle connector. The straddle mount connector also includes a dielectric connector body having a platform for supporting the contacts. The platform includes a plurality of dividers between each of the contacts, where the dividers define a plurality of channels that receive the contacts. The dividers extend from the platform beyond the contacts such that the contacts are recessed below an outer surface of the dividers.

Optionally, the contacts may have a width measured along the platform, and the contacts may be spaced apart by a spacing at least as wide as the width of the contacts. The contacts may have a height measured from platform, and the dividers may have a height being at least twice the height of the contacts. Optionally, the contacts may have a mating surface opposite the platform, where the mating surfaces are generally coplanar along a contact plane. The dividers may have an outer surface, where the outer surfaces are generally coplanar along a divider plane. The contact plane may be located closer to the platform than the divider plane. The channels may have a width that is wider than a width of the contacts of the receptacle connector.

In another embodiment, a straddle mount connector for edge mounting to a circuit board of a pluggable module is provided that includes a dielectric connector body having a base configured to be coupled to the circuit board and platform extending from the base. A plurality of dividers extend from the platform to an outer surface, and the dividers define a plurality of channels therebetween. A plurality of contacts are held by the connector body. The contacts include a contact base being securely coupled to the base of the connector body and a contact tail extending from the contact base along the platform and being configured to engage mating contacts of a receptacle connector. The contact tails are received in corresponding channels such that the contact tails are recessed below the outer surface of the dividers.

In a further embodiment, a transceiver assembly is provided including a receptacle assembly and a pluggable module coupled to the receptacle assembly. The receptacle assembly includes a receptacle guide frame configured to be mounted to a host circuit board and a receptacle connector received within the receptacle guide frame. The receptacle guide frame has a front being open to an interior space. The receptacle connector is positioned within the interior space of the receptacle guide frame at a rear of the receptacle guide frame. The receptacle connector has a plurality of contacts arranged at a mating interface of the receptacle connector. The pluggable module includes a housing having a circuit board therein with a plurality of contact pads arranged at the mating edge. The pluggable module also includes a straddle mount connector coupled to the mating edge of the circuit board. The straddle mount connector includes a dielectric connector body having a platform with a plurality of dividers that define channels therebetween, and the straddle mount connector includes a plurality of contacts held by the connector body such that the contacts engage corresponding contact pads of the circuit board and such that the contacts are received in corresponding channels. The contacts are recessed below an outer surface of the dividers.

DETAILED DESCRIPTION OF THE INVENTION

Figure 1:
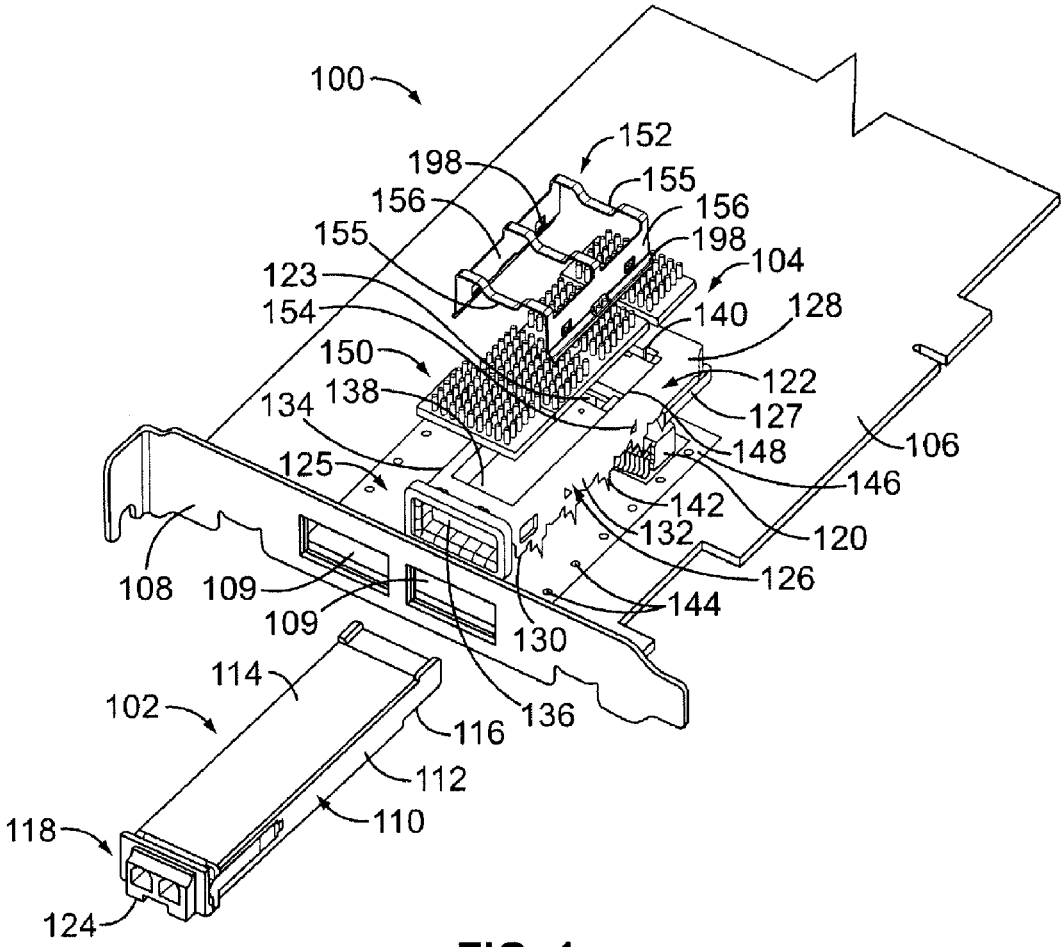
FIG. 1 is an exploded perspective view of a transceiver assembly formed in accordance with an exemplary embodiment.

FIG. 1 illustrates a transceiver assembly 100 adapted to address, among other things, conveying data signals at high rates, such as data transmission rates of 10 gigabits per second (Gbps) required of the XFP standard. It is appreciated, however, that the benefits and advantages of the subject matter described herein may accrue equally to other data transmission rates and across a variety of systems and standards.

As shown in FIG. 1, the assembly 100 generally includes a pluggable module 102 configured for pluggable insertion into a receptacle assembly 104 that is mounted to a host circuit board 106, which, in turn, is mounted in a host system such as a router or computer (not shown). The host system typically includes a conductive chassis having a bezel 108 including openings 109 therethrough in substantial alignment with a respective receptacle assembly 104. The pluggable module 102 is inserted into the receptacle assembly 104 through the bezel opening 109, and the receptacle assembly 104 is electrically connected to the bezel 108.

In the illustrated embodiment, the pluggable module 102 includes a housing 110 including a base 112 and a cover 114 that are secured together to form a protective shell for a circuit board (not shown in FIG. 1) that is disposed within the housing 110. The circuit board carries electronic circuitry and devices that perform transceiver functions in a known manner. An edge of the circuit board is exposed through a rear 116 of the housing 110, and the circuit board edge is pluggable into the receptacle assembly 104 as described below. Alternatively, a connector may be mounted to the circuit board and exposed through the rear 116 of the housing 110 for plugging into the receptacle assembly 104. The pluggable module 102 is adapted for installation into the receptacle assembly 104 such that a front end 118 of the pluggable module 102 is extended therefrom.

The pluggable module 102 is configured to be inserted into the receptacle assembly 104. In general, the pluggable module 102 and receptacle assembly 104 may be used in any application requiring an interface between a host system and electrical or optical signals. The pluggable module 102 interfaces to the host system through the receptacle assembly 104 via a receptacle connector 120 which is located within a receptacle guide frame 122, also referred to as a cage. The pluggable module 102 interfaces to an optical fiber or electrical cable (not shown in FIG. 1) through a connector interface 124 at a front end 118 of the pluggable module 102. Preferably, the connector interface 124 comprises a mechanism that cooperates with a fiber or cable assembly (not shown) to secure the fiber or cable assembly to the pluggable module 102. Suitable connector interfaces 124 are known and include adapters for the LC style fiber connectors and the MTP/MPO style fiber connectors offered by Tyco Electronics Corporation (Harrisburg, Pa.).

The pluggable module 102 and the receptacle assembly 104 reduce EMI emission through one or more of several EMI reduction features, including a guide frame 122, a gasket assembly 125 coupled to a forward end of the guide frame 122 that interfaces with the bezel 108, and intermediate and rear gasket assemblies 123 and 127.

As illustrated in FIG. 1, the guide frame 122 includes a stamped and formed metal body 126 that defines a shell having a top wall 128, a bottom wall 130, and side walls 132, 134. Front edges of each of the top, bottom and side walls 128, 130, 132, 134 are formed as flanges which surround a front opening 136 into the guide frame 122. The top wall 128, the bottom wall 130, and the side walls 132, 134 define a cavity 138 therebetween for receiving the pluggable module 102 through the opening 136 in the front end of the guide frame 122. The bottom wall 130 has a bottom opening to receive the receptacle connector 120. The guide frame 122 has a positive stop 140, which engages a surface of the pluggable module 102 to prevent the pluggable module 102 from passing too far rearwardly through the guide frame 122. When the pluggable module 102 is inserted into the receptacle assembly 104, the guide frame 122 provides conductive walls on all sides thereof. Bottom wall 130 of guide frame 122 includes compliant pin leads 142 that are received within through-holes 144 of the host board 106 and provide a conductive path to ground of an equipment chassis when the receptacle assembly 104 is mounted therein. The host board 106 includes a conductive surface 146 provided thereon and formed as a sheet to underlie the receptacle assembly 104 to enhance the electromagnetic interference shielding.

The receptacle connector 120 is mounted on the circuit board 106 of the host equipment along with the guide frame 122, but separated from the conductive surface 146 of the host board 106. The receptacle connector 120 includes a slot that receives an edge of the circuit board or a connector mounted to the circuit board that is carried by the pluggable module 102 when the pluggable module 102 is fully installed in the guide frame 122, thereby electrically connecting the pluggable module 102 to the host equipment.

The top wall 128 of the guide frame 122 has a large opening 148 overlying the cavity 138 that accommodates an optional heat sink 150. The heat sink 150 is positioned to make physical contact with the pluggable module 102 when the pluggable module 102 is installed into the receptacle assembly 104. A clip 152 is mounted over the heat sink 150 and is secured to the guide frame 122. The clip 152 ensures that the heat sink 150 is loaded against the pluggable module 102 to facilitate thermal transfer from the pluggable module 102 to the heat sink 150. The heat sink 150 includes an engagement surface that faces and is located proximate the interior cavity 138 of the guide frame 122. The engagement surface of the heat sink 150 is configured to physically contact and abut against the pluggable module 102 when installed in the interior cavity 138.

A retention tab 154 is formed on each of the side walls 132, 134 of the guide frame 122. The retention tabs 154 engage the clip 152 which, in turn, retains the heat sink 150 on the guide frame 122. The clip 152 securely engages the guide frame 122 to retain the heat sink 150 upon the guide frame 122. The clip 152 includes resilient spring members 155 secured over the heat sink 150. The spring members 155 flex to permit the heat sink 150 to move outward away from the guide frame 122 when the pluggable module 102 is installed. The spring members 155 exert a desired force against the heat sink 150 to maintain a desired abutting interface to facilitate thermal transfer and heat dissipation from the pluggable module 102. The clip 152 further includes side rails 156 that snap over the side walls 132, 134 of the guide frame 122. The side rails 156 are joined to one another by the spring members 155 that extend over, and flexibly engage, the heat sink 150.

Figure 2:
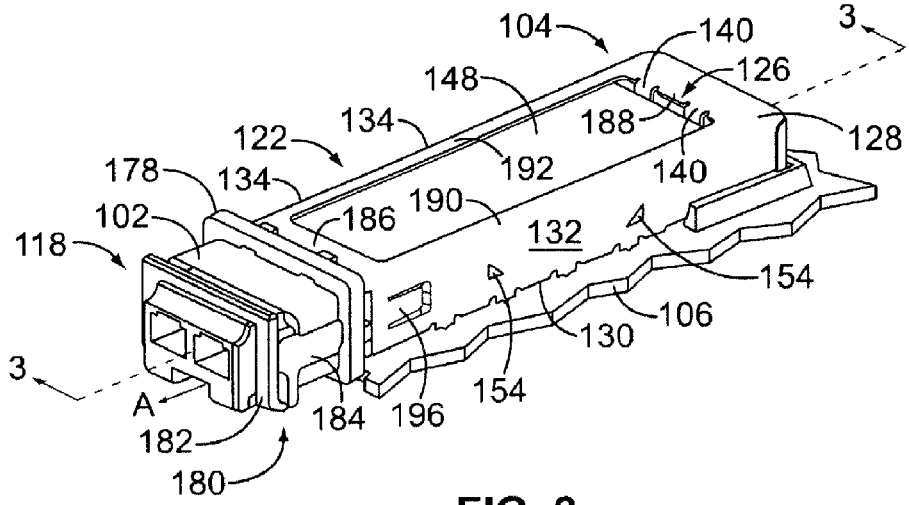
FIG. 2 is an assembled perspective view of a portion of the assembly shown in FIG. 1, showing a pluggable module mated with a receptacle assembly.

FIG. 2 is a perspective view of the receptacle assembly 104 mounted to the host board 106 and receiving the pluggable module 102, with the heat sink 150 and the clip 152 removed for clarity. Also, the bezel 108 is not shown in FIG. 2.

The pluggable module 102 is illustrated in a latched position wherein removal from the guide frame 122 is prevented. An axial pull on the front end 118 of the pluggable module 102 in the direction of arrow A, when latched, is ineffective to remove the pluggable module 102. In the latched position, the front end 118 of the pluggable module 102 extends or protrudes outwardly a specified distance from an EMI gasket collar 178 which is positioned in abutting contact with an interior surface (not shown in FIG. 2) of the bezel 108 (shown in FIG. 1) in use. The pluggable module 102 is extended through collar 178 and guide frame 122. An ejector mechanism 180 is provided on the front end 118 of the pluggable module 102 and includes a rotatably mounted bail 182 and actuator arms 184 extending on opposite sides thereof in a generally parallel direction to the side walls 132, 134 of guide frame 122.

The top wall 128 of the guide frame 122 includes a front portion 186, a rear portion 188, and opposed lateral portions 190, 192 that define a perimeter of the opening 148. The portions 186-192 of the top wall 128 also define a seat for the heat sink 150 (shown in FIG. 1). The top wall 128 supports the heat sink 150 when the heat sink 150 is mounted over the opening 148. Retention tabs 154 are punched from each of the respective side walls 132, 134 and bent outwardly. The retention tabs 154 engage mating openings 198 (shown in FIG. 1) in the side rails 156 (shown in FIG. 1) in the clip 152 (also shown in FIG. 1) when the heat sink 150 is attached to the guide frame 122. In an exemplary embodiment, the retention tabs 154 are triangular in shape, which restricts the clip 152 from movement in both a vertical and horizontal direction relative to the guide frame 122, although it is recognized that other shapes for tabs 154 maybe employed.

The rear portion 188 of the top wall 128 includes positive stops 140 in the form of downwardly extending tabs that project slightly inward into opening 148 and downward into the cavity 138. The stops 140 engage a rear surface of the pluggable module 102 to prevent the pluggable module 102 from passing rearwardly through the guide frame 122 beyond a specified distance. Each of the side walls 132, 134 of the guide frame 122 includes a latch element 196 that engages a respective cavity in the sidewalls 132, 134 of the pluggable module 102. In the illustrated embodiment, the latch elements 196 are rectangular tabs punched from the respective side walls 132, 134 and bent inwardly into the interior of the cavity 138 of the guide frame 122. When the pluggable module 102 is inserted in the guide frame 122, the latch elements 196 contact the side outer surfaces of the housing 110 (shown in FIG. 1) of the pluggable module 102 and resiliently deflect outwardly to permit insertion of the pluggable module 102. Once the pluggable module 102 is inserted a predetermined distance into the guide frame 122, the latch elements 196 return to the latched position illustrated in FIG. 2 in engagement with the cavity in the sidewalls 132, 134.

Figure 3:
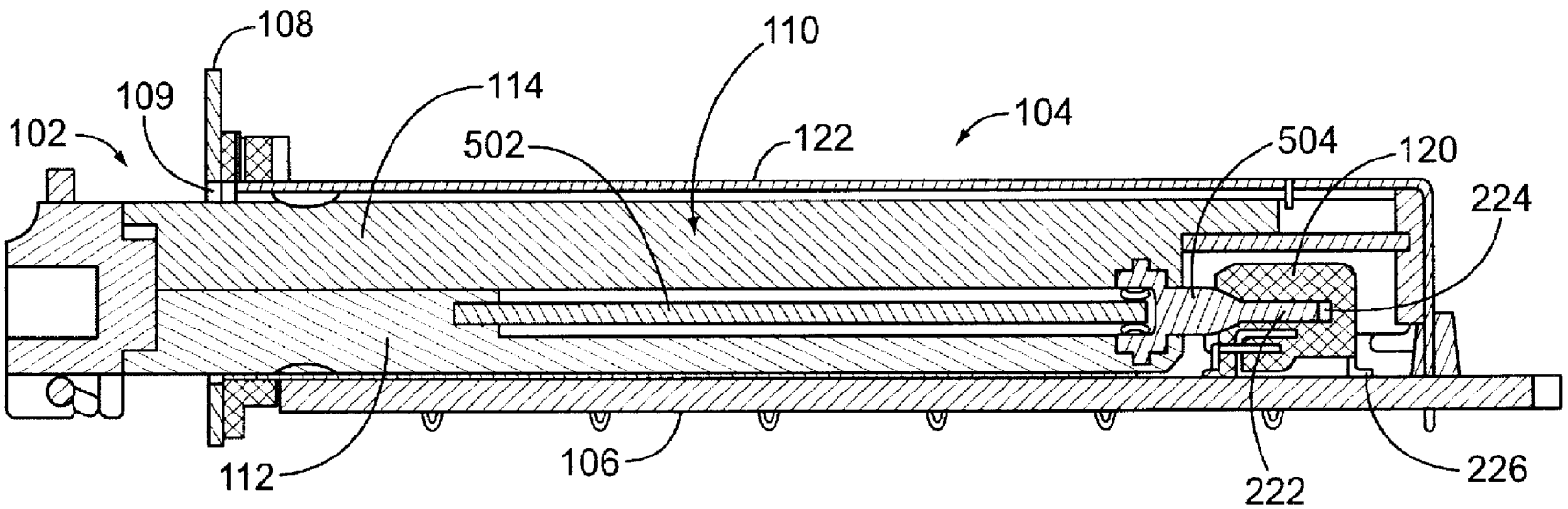
FIG. 3 is a cross sectional view of a portion of the assembly shown in FIG. 1, showing the pluggable module mated with the receptacle assembly.

FIG. 3 is a cross sectional view of the pluggable module 102 coupled to the receptacle assembly 104 with the pluggable module 102 in the latched position. The pluggable module 102 includes a printed circuit board 502 within the housing 110 held by the base 112 and the cover 114. A straddle mount connector 504 is mounted to the end of the circuit board 502 and is electrically connected thereto, as described in further detail below. An end 222 of the straddle mount connector 504 is received in a slot 224 of the receptacle connector 120 which is mechanically and electrically mounted to the host board 106. The receptacle connector 120 includes electrical contacts 226 that engage contacts 520 (shown in FIG. 4) of the straddle mount connector 504. The electrical contacts 226 may define upper and lower contacts that engage opposed sides of the straddle mount connector 504. The contacts 520 are electrically connected to conductive pads on the end of the printed circuit board 502 to establish an electrical connection of the printed circuit board 502 with the host board 106. When the pluggable module 102 is inserted into the guide frame 122, the end 222 of straddle mount connector 504 is inserted into the connector slot 224, and when the pluggable module 102 is fully inserted into the guide frame 122, the pluggable module 102 is locked in the latched position with the straddle mount connector 504 fully engaged to the receptacle connector 120.

Figure 4:
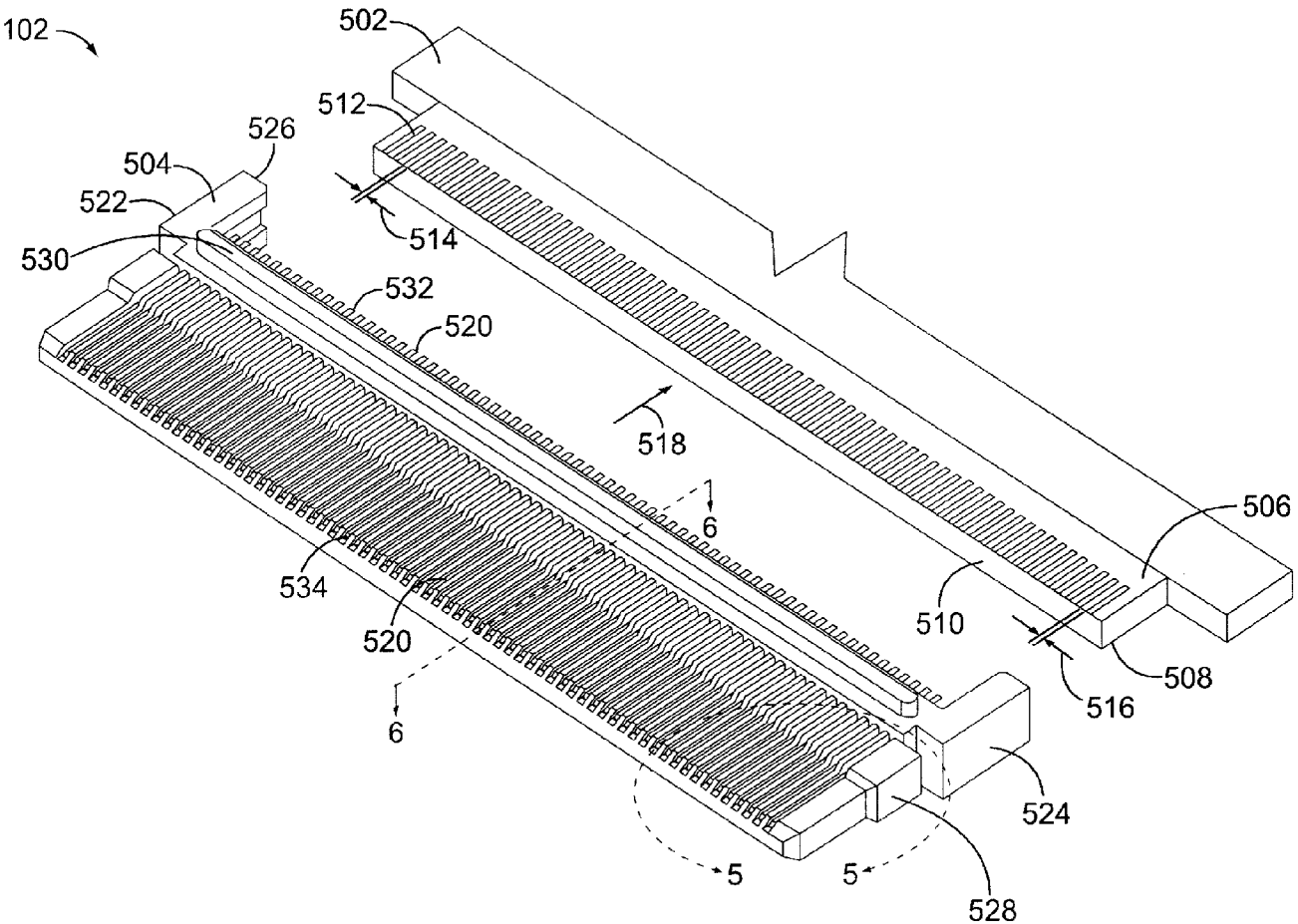
FIG. 4 is an exploded view of a portion of the pluggable module illustrating a circuit board and a straddle mount connector for mounting to the circuit board.

FIG. 4 is an exploded view of a portion of the pluggable module 102 formed in accordance with an exemplary embodiment illustrating the circuit board 502 and the straddle mount connector 504. The circuit board 502 includes an upper surface 506 and a lower surface 508. The circuit board 502 includes a mating edge 510 and a plurality of contact pads 512 arranged at the mating edge 510. In an exemplary embodiment, contact pads 512 are arranged on the upper surface 506 and the lower surface 508. The contact pads 512 have a width 514 and are spaced apart from one another by a spacing 516. Optionally, the width 514 and/or the spacing 516 may be the same for each of the contact pads 512.

The straddle mount connector 504 is configured to be mounted to the mating edge 510 of the circuit board 502. For example, the straddle mount connector 504 is loaded onto the mating edge 510 in a loading direction 518. The straddle mount connector 504 includes a plurality of contacts 520 that engage corresponding contact pads 512 of the circuit board 502. In an exemplary embodiment, the contacts 520 straddle both surfaces 506, 508 of the circuit board 502 to electrically connect to contact pads 512 on both the upper surface 506 and the lower surface 508.

The straddle mount connector 504 includes a dielectric connector body 522 having a base 524 at a front 526 of the connector body 522. The connector body 522 also includes a platform 528 that extends rearwardly from the base 524. The base 524 receives a portion of the circuit board 502 and may be securely coupled thereto, such as by an interference fit or by using other fastening means such as latches, fasteners, adhesive and the like. Optionally, ribs 530 may extend from the top and/or bottom of the base 524 for interfacing with the housing of the pluggable module 102. For example, the ribs 530 may be captured within the base and/or cover of the housing of the pluggable module 102 when the pluggable module 102 is assembled to secure the straddle mount connector 504 with respect to the housing at the rear thereof.

The contacts 520 are held by the connector body 522. In an exemplary embodiment, the contacts 520 extend between a termination end 532 and a mating end 534. The termination end 532 of the contacts 520 are configured to be electrically connected to the contact pads 512 of the circuit board 502. The mating end 534 of the contacts 520 are configured to be electrically connected to corresponding upper and/or lower mating contacts 226 of the receptacle connector to create an electrical connection between the receptacle connector and the pluggable module 102. The termination end 532 of each contact 520 is positioned proximate to the base 524 and the mating end 534 of each contact 520 is positioned along the platform 528. The platform 528 supports the mating ends 534 of the contacts 520.

Figure 5:
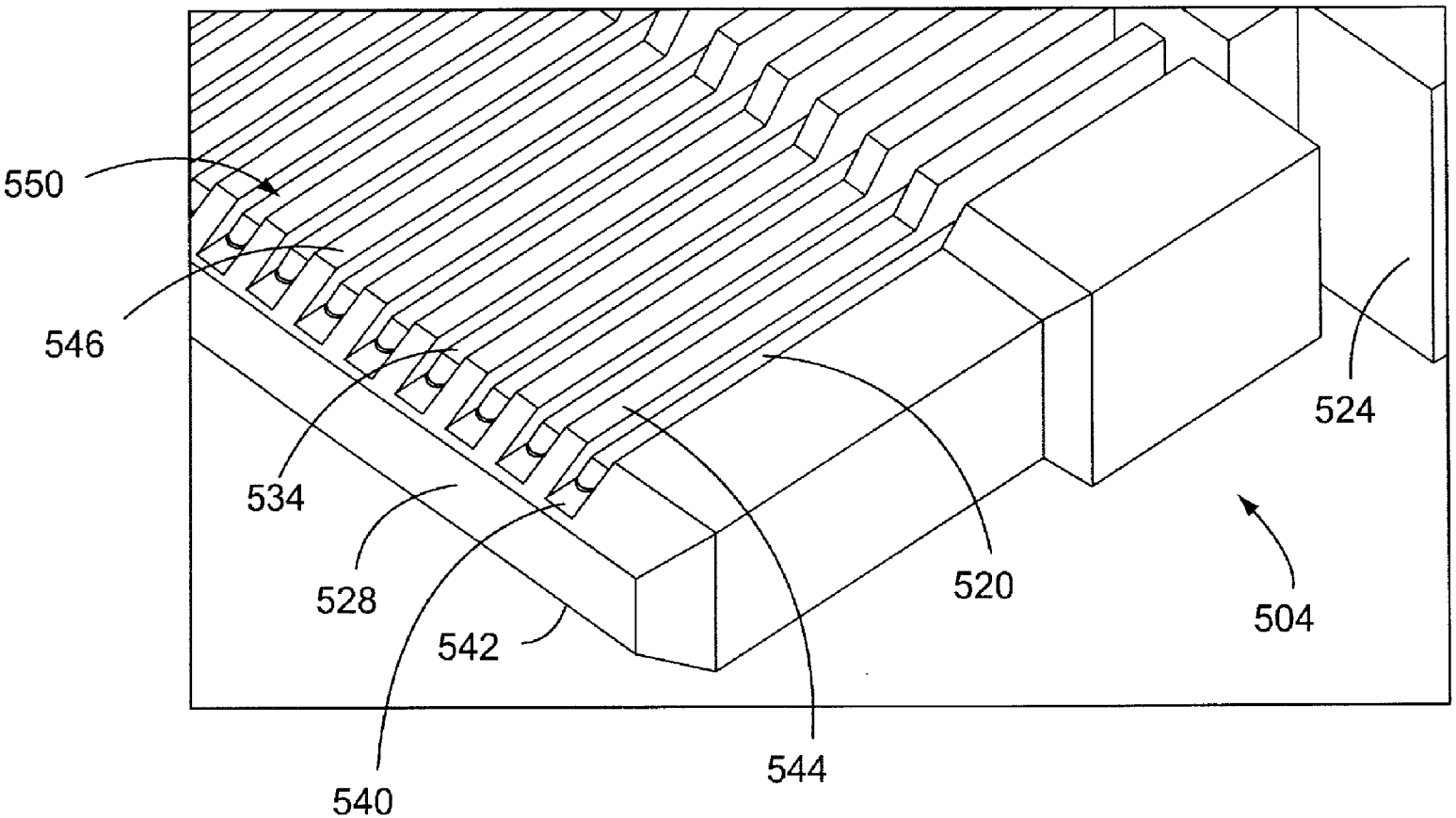
FIG. 5 is an enlarged view of a portion of the straddle mount connector shown in FIG. 4 taken along line 5-5 shown in FIG. 4.

FIG. 5 is an enlarged view of a portion of the straddle mount connector 504 enclosed within elliptical line 5-5 shown in FIG. 4. FIG. 5 generally illustrates the platform 528 of the straddle mount connector 504 and the contacts 520 held by the platform 528. The platform 528 includes an upper surface 540 and an opposite lower surface 542. The platform 528 includes a plurality of dividers 544 extending from the upper and lower surfaces 540, 542 to an upper outer surface 546 and a lower outer surface 548 (shown in FIG. 6), respectively. The dividers 544 define channels 550 that receive the contacts 520. The dividers 544 extend from the platform 528 beyond the contacts 520 such that the contacts 520 are recessed below the outer surfaces 546, 548 of the dividers 544.

Figure 6:
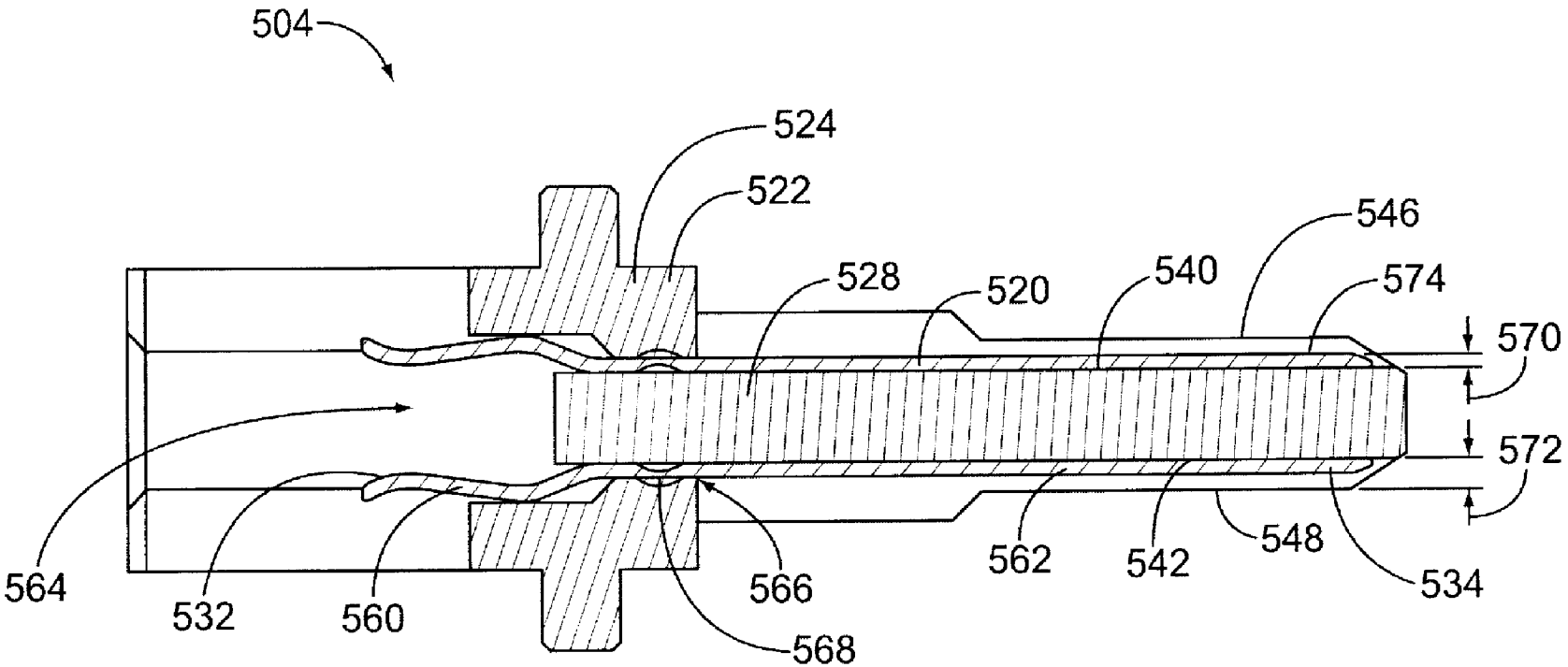
FIG. 6 is a cross-sectional view of the straddle mount connector shown in FIG. 4 taken along line 6-6 shown in FIG. 4.

FIG. 6 is a cross-sectional view of the straddle mount connector 504 taken along line 6-6 shown in FIG. 4. FIG. 6 illustrates the contacts 520 being held by the connector body 522. The contacts 520 include a contact base 560 being securely coupled to the base 524 of the connector body 522 and a contact tail 562 extending from the contact base 560. The contact base 560 extends between the termination end 532 and the contact tail 562. In an exemplary embodiment, the contacts 520 may be arranged in pairs including an upper contact and a lower contact that are aligned with one another on opposite sides of the platform 528 and the base 524. A space 564 is provided between the upper and lower contacts of each pair that receives the circuit board 502 (shown in FIG. 4). The upper contact is configured to engage a corresponding contact pad 512 (shown in FIG. 4) on the upper surface 506 (shown in FIG. 4) of the circuit board 502. The lower contact is configured to engage a corresponding contact pad 512 on the lower surface 508 (shown in FIG. 4) of the circuit board 502. In an exemplary embodiment, the termination ends 532 of the contacts 520 may be soldered to the respective contact pads 512. Other termination means are possible in alternative embodiments.

The contact tail 562 generally extends along either the upper or lower surface 540, 542 of the platform 528. The contact tail 562 extends to the mating end 534. In an exemplary embodiment, the contact tail 562 is generally coplanar with the contact base 560. Other arrangements are possible in alternative embodiments.

During assembly, the contacts 520 are loaded through openings 566 in the base 524. The openings 566 are aligned with the platform 528 such that the contact tails 562 emerge from the openings 566 to extend along the platform 528. Optionally, the contact base 560 may include a retention boss 568 that engages a portion of the base 524 to provide interference therewith to hold the contact 520 in position with respect to the connector body 522.

The contacts 520 have a height 570 measured from the upper or lower surface 540, 542. The dividers 544 have a height 572 measured from the upper or lower surface that is greater than the height 570 of the contacts 520. As such, a mating surface 574 of each contact 520 is recessed with respect to the outer surface 546, 548 of the dividers 544. In the illustrated embodiment, the height 572 of the dividers 544 is approximately twice the height 570 of the contacts 520. However, the height 572 of the dividers 544 may be more or less than twice the height 570 of the contacts 520.

Figure 7:
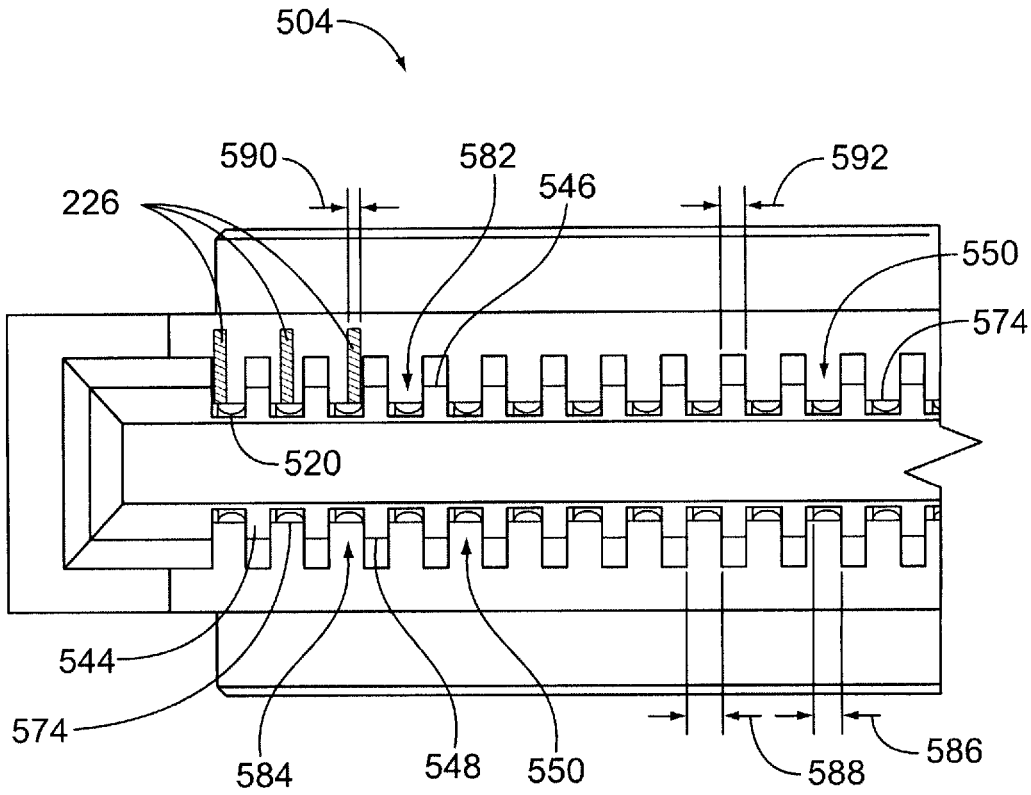
FIG. 7 is a rear elevational view of a portion of the straddle mount connector.

FIG. 7 is a rear elevational view of a portion of the straddle mount connector 504 illustrating the mating contacts 226 of the receptacle connector 120 (shown in FIG. 3) mated with some of the contacts 520. While only three of the mating contacts 226 are illustrated in the upper row, any number of the mating contacts 226 may be provided, such as one mating contact for each corresponding contact 520 of the straddle mount connector 504. Additionally, the mating contacts 226 may similarly be mated with the contacts 520 in the lower row of contacts of the straddle mount connector 504. FIG. 7 also illustrates the dividers 544 extending beyond the mating surfaces 574 of the contacts 520. For example, the upper outer surface 546 is positioned above the mating surface 574 of the upper contacts 520. A holding area 582 is formed within the upper channels 550 for receiving the mating contacts 226. Similarly, the lower outer surface 548 is positioned below the mating surface 574 of the lower contacts 520. A holding area 584 is formed within the lower channels 550 for receiving the mating contacts 226. The holding areas 582, 584 position the mating contacts 226 in substantial alignment with the contacts 520. The dividers 544 are configured to guide the mating contacts 226 into the corresponding holding areas 582, 584. As such, if any of the mating contacts are misaligned with the contacts 520 and corresponding channels 550, the dividers 544 are configured to deflect the mating contacts 226 to force the mating contacts 226 into the channels 550 to ensure engagement with the contacts 520.

The contacts 520 have a contact width 586. The channels 550 have a channel width 588 that is wider than the contact width 586. The mating contacts 226 have a mating contact width 590 that is narrower than the channel width 588. As such, the mating contacts 226 are configured to fit within the channels 550. In the illustrated embodiment, the contact width 586 is less than the channel width 588 such that the channels 550 can accommodate variations in the contact width 586 from manufacturing and/or to accommodate various positions of the contact 520 during assembly. For example, the contacts 520 may be shifted to the right, or to left, or be substantially centered within the channels 550. Different contacts 520 may be positioned differently within the channels 550. In the illustrated embodiment, the contact width 586 is approximately 0.35 mm, the channel width 588 is approximately 0.45 mm, and the mating contact width 590 is approximately 0.2 mm. The noted widths are exemplary of the illustrated embodiment, and are not limited to the widths noted above The dividers 544 have a divider width 592 that affects a spacing between adjacent contacts 520. For example, electrical characteristics, such as crosstalk, impedance and the like, of the contacts 520 may be affected by the spacing between adjacent contacts 520. In the illustrated embodiment, the divider width 592 is substantially the same as the contact width 586. The divider width 592 may be different in alternative embodiments. Optionally, surfaces of the dividers 544 may be chamfered or radiused to guide the mating contacts 226 into the channels 550. For various contact spacings, the contact width 586, channel widths, 588, and divider width 592 can be adjusted to achieve the desired impedance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A pluggable module for mating with a receptacle connector of a host device, the pluggable module comprising:

a housing having a front and a rear;

a circuit board held by the housing, the circuit board having a mating edge and a plurality of contact pads arranged at the mating edge; and a straddle mount connector coupled to the mating edge of the circuit board, the straddle mount connector comprising:

a plurality of contacts engaging corresponding contact pads, the contacts extending between a termination end coupled to the contact pads and a mating end configured to engage corresponding contacts of the receptacle connector; and a dielectric connector body having a platform for supporting the contacts, the platform includes a plurality of dividers defining channels therebetween, the channels receiving corresponding contacts, wherein the dividers extend from the platform beyond the contacts such that the contacts are recessed below an outer surface of the dividers.

2. The pluggable module of claim 1, wherein the contacts have a width measured along the platform, the contacts being spaced apart by a spacing at least as wide as the width of the contacts.

3. The pluggable module of claim 1, wherein the contacts have a height measured from platform, the dividers have a height being at least twice the height of the contacts.

4. The pluggable module of claim 1, wherein the contacts have a mating surface opposite the platform, the mating surfaces being generally coplanar along a contact plane, the outer surfaces of the dividers being generally coplanar along a divider plane, the contact plane being located closer to the platform than the divider plane.

5. The pluggable module of claim 1, wherein the channels have a width that is wider than a width of the contacts of the receptacle connector.

6. The pluggable module of claim 1, wherein the dividers are configured to guide the contacts of the receptacle connector to the contacts within the channels.

7. The pluggable module of claim 1, wherein the platform includes opposed upper and lower surfaces, the upper and lower surfaces both have dividers and channels, the contacts being arranged in the channels on both the upper and lower surfaces of the platform, the contacts in the channels on the upper surface of the platform engaging an upper surface of the circuit board, the contacts in the channels on the lower surface of the platform engaging a lower surface of the circuit board.

8. The pluggable module of claim 1, wherein the contacts include a contact base being securely coupled to the connector body and engaging corresponding contact pads of the circuit board, the contacts include a contact tail extending from the contact base along the platform and being configured to engage corresponding contacts of the receptacle connector.

9. A straddle mount connector for edge mounting to a circuit board of a pluggable module, the straddle mount connector comprising:

a dielectric connector body having a base configured to be coupled to the circuit board and platform extending from the base, a plurality of dividers extend from the platform to an outer surface opposite the platform, the dividers define a plurality of channels therebetween the channels being open between the outer surfaces of the adjacent dividers; and a plurality of contacts held by the connector body, the contacts include a contact base being securely coupled to the base of the connector body and a contact tail extending from the contact base along the platform and being configured to engage mating contacts of a receptacle connector, the contact tails being received in corresponding channels such that the contact tails are recessed below the outer surface of the dividers.

10. The straddle mount connector of claim 9, wherein the connector body has openings through the base aligned with the channels, the contacts being loaded through the openings into the channels.

11. The straddle mount connector of claim 9, wherein the contacts are arranged in pairs aligned with one another on opposite sides of the platform and base, the contact bases of the pair of contacts are configured to engage contact pads on opposite sides of the circuit board.

12. The straddle mount connector of claim 9, wherein the contacts have a width measured along the platform, the contacts being spaced apart by a spacing at least as wide as the width of the contacts.

13. The straddle mount connector of claim 9, wherein the contacts have a contact width measured along the platform, the dividers being spaced apart from one another such that the channels have a channel width greater than the contact width, the channel width being selected such that mating with the mating contacts is ensured even when the mating contacts engage one of the dividers.

14. The straddle mount connector of claim 9, wherein the contacts have a mating surface opposite the platform, the mating surfaces being generally coplanar along a contact plane, the outer surfaces of the dividers being generally coplanar along a divider plane, the contact plane being located closer to the platform than the divider plane.

15. The straddle mount connector of claim 9, wherein the platform includes opposed upper and lower surfaces, the upper and lower surfaces both have dividers and channels, the contacts being arranged in the channels on both the upper and lower surfaces of the platform.

16. A transceiver assembly comprising:

a receptacle assembly comprising a receptacle guide frame configured to be mounted to a host circuit board and a receptacle connector received within the receptacle guide frame, the receptacle guide frame having a front being open to an interior space, the receptacle connector being positioned within the interior space of the receptacle guide frame at a rear of the receptacle guide frame, the receptacle connector having a plurality of contacts arranged at a mating interface of the receptacle connector; and a pluggable module coupled to the receptacle assembly, the pluggable module comprising a housing having a circuit board therein with a plurality of contact pads arranged at the mating edge, and a straddle mount connector coupled to the mating edge of the circuit board, wherein the straddle mount connector includes a dielectric connector body having a platform with a plurality of dividers that define channels therebetween, and wherein the straddle mount connector includes a plurality of contacts held by the connector body such that the contacts engage corresponding contact pads of the circuit board and such that the contacts are received in corresponding channels, the contacts are recessed below an outer surface of the dividers.

17. The assembly of claim 16, wherein the contacts have a width measured along the platform, the contacts being spaced apart by a spacing at least as wide as the width of the contacts.

18. The assembly of claim 16, wherein the contacts have a height measured from platform, the dividers have a height being at least twice the height of the contacts.

19. The pluggable module of claim 1, wherein the platform includes a planar support surface, the dividers extending outward from the support surface to the outer surfaces, the channels being open between the dividers opposite the support surface.

20. The pluggable module of claim 1, wherein each channel receives a single contact therein, the dividers being configured to guide the contacts of the receptacle connector to the corresponding contacts in the channels.

* * * * *